US007353550B2

(12) United States Patent
Antinori

(10) Patent No.: US 7,353,550 B2
(45) **Date of Patent: *Apr. 8, 2008**

(54) RETAINER SYSTEM FOR ADJUSTABLE BEDS

(76) Inventor: Steven J. Antinori, 4908 St. Croix Dr., Tampa, FL (US) 33629

( * ) Notice: Subject to any disclaimer, the term of this patent is extended or adjusted under 35 U.S.C. 154(b) by 0 days.

This patent is subject to a terminal disclaimer.

(21) Appl. No.: 11/393,804

(22) Filed: Mar. 31, 2006

(65) Prior Publication Data

US 2006/0168725 A1 Aug. 3, 2006

Related U.S. Application Data

(62) Division of application No. 10/944,833, filed on Sep. 21, 2004, now Pat. No. 7,036,170.

(51) Int. Cl.
*A47C 27/00* (2006.01)
*A47C 27/04* (2006.01)

(52) U.S. Cl. ..... 5/411; 5/694

(58) Field of Classification Search ..... 5/694, 5/691, 690, 738, 739, 639, 655.9, 716, 485, 5/653, 652

See application file for complete search history.

(56) References Cited

U.S. PATENT DOCUMENTS 1,125,277 A 1/1915 Eckerson
1,371,098 A 3/1921 Jones
1,842,873 A 1/1932 Leeking
2,995,762 A 8/1961 Albinson
4,017,919 A 4/1977 Hemmeter
4,297,754 A 11/1981 Zuniga
5,111,544 A 5/1992 Graebe
5,475,886 A * 12/1995 Mintz ..... 5/653
5,737,783 A 4/1998 Antinori
5,896,605 A 4/1999 Branman
5,978,992 A 11/1999 Antinori
2002/0066142 A1 6/2002 Osborne et al.

* cited by examiner

*Primary Examiner*—Alexander Grosz
(74) *Attorney, Agent, or Firm*—Diller, Ramik & Wight

(57) ABSTRACT

The invention is directed to a mattress retainer system for adjustable beds which includes a mattress-retention bracket housed within a pocket of a mattress accessible in an upward direction through an opening along a bottom edge of the mattress. The pocket is formed by attaching a separate piece of material along a bottom edge of the mattress at one or both of opposite head/foot ends thereof and permitting an overlying downwardly projecting portion of a peripheral covering of the mattress to remain free thereby defining the opening into the pocket.

11 Claims, 4 Drawing Sheets

RETAINER SYSTEM FOR ADJUSTABLE BEDS

CROSS-REFERENCE TO RELATED APPLICATIONS

This application is a divisional of application of U.S. patent application Ser. No. 10/944,833 filed on Sep. 21, 2004, and now U.S. Pat. No. 7,036,170.

BACKGROUND OF THE INVENTION

The invention relates to a retainer system for adjustable beds and specifically to a pocket formed in a mattress for receiving a retention bracket which is carried by a mattress-supporting element, such as a foot support and/or a head support of an adjustable bed, or a box spring, etc. With the retention bracket housed within the pocket of the mattress, the mattress cannot shift during adjustment of the adjustable bed and, more importantly, because of the novel construction of the pocket, the retention bracket is hidden from view and creates an aesthetic appearance to an observer.

A typical conventional mattress-retention bracket constructed in accordance with this invention is disclosed in U.S. Pat. Nos. 5,737,783 and 5,978,992 in the name of Santino Antinori granted respectively on Apr. 14, 1998 and Nov. 9, 1999. In each of these patents a mattress-retention bracket is of a generally inverted U-shaped configuration or an upstanding T-shaped configuration, and these retention brackets are secured to head, back, hip and/or foot supports of an adjustable bed. The retention brackets embrace the head, back, hip and/or foot ends of the overlying mattress and are functionally adequate for the intended purpose, but are not aesthetically acceptable because they are readily visible to a casual observer. However, in accordance with the mattress-retainer system of the present invention, such brackets are hidden from view by providing a lower opening along a peripheral edge of the mattress which opens into a pocket into which the mattress-retainer bracket can be inserted. An outer portion of the peripheral material defining the mattress cover covers the retention bracket thereby hiding the same and providing the mattress with the appearance of a conventional or standard mattress absent a pocket therein.

Other typical mattress holders and/or brackets are disclosed in U.S. Pat. No. 1,125,277 granted on Jan. 19, 1915 to Homer Eckerson and U.S. Pat. No. 1,371,098 granted on Mar. 8, 1921 to Mariana T. Jones. In each of these patents a bed frame includes a set of supporting springs upon which rests a mattress and mattress holders or brackets are attached to head ends and foot ends of the bedframe to permit the mattress to shift relative to the frame and the springs supported thereby.

U.S. Pat. No. 4,297,754 granted on Nov. 3, 1981 to Julio A. Zuniga and U.S. Pat. No. 4,017,919 granted on Apr. 19, 1977 to John H. Hemmeter each disclose a plurality of mattress-retention brackets associated with a bed, and in each of these the mattress is supported upon box springs and the mattress-retention brackets prevent each mattress from shifting relative to its associated box spring.

U.S. Pat. No. 1,842,873 granted on Jan. 26, 1932 to Mary E. Leeking discloses an adjustable bed formed by a head spring section, a foldable foot spring section and an intermediate foldable spring section therebetween with the three sections supporting a mattress and several sections being adjusted to accommodate a patient in prone, sitting or partially sitting positions. Rather than utilizing retention brackets, the mattress is held to the head, intermediate and foot spring sections by a number of flexible straps having a hooks at opposite ends which are selectively hooked to the spring sections and to eyelets or eye members of the mattress.

Published U.S. Patent Application No. 2002/0066142 A1 published on Jun. 6, 2002 in the name of Osborne et al. discloses a mattress having a transverse tubular sleeve along an underside thereof through which a rod passes with the rod being secured to an underlying mattress-supporting surface, such as a box spring for retaining the mattress positioned atop the box spring.

SUMMARY OF THE INVENTION

In keeping with the foregoing, a novel mattress-retention system particularly adapted for association with adjustable beds includes a retention bracket which can be configured in a variety of different ways, such as the retention brackets of U.S. Pat. Nos. 5,737,783 and 5,978,992 connected in upstanding projected relationship at a head end, a foot end or both head and foot ends of an associated mattress support, such as head and/or foot supports of an adjustable bed. A mattress associated with the adjustable bed is provided with a downwardly opening pocket at its head end, foot end or both its head and foot ends. The mattress includes a conventional inner mattress core which may include coil springs, polymeric/copolymeric foam plastic, combinations thereof, and upper, lower and peripheral outermost pieces of fabric which are conventionally secured together by a conventional tape edging machine except along lower or bottom edges of the head and/or foot ends of the peripheral fabric material. At one or both of the latter ends of the mattress, the peripheral edge of the mattress bottom covering and a lower edge of the peripheral covering are not edge-taped together thereby forming an upwardly accessible hidden pocket which can be accessed by the retention bracket(s). Since the retention bracket(s) is inboard of the outermost peripheral covering or fabric material of the mattress, it is unobservable from the exterior thereby imparting a highly aesthetic appearance to the overall adjustable bed and virtually renders invisible the mattress-retention bracket(s).

In a preferred embodiment of the invention, the bracket-retention pocket(s) is formed by manufacturing a mattress in a conventional manner except a limited length of the head end and/or foot end of the mattress periphery are not sewn together utilizing typical tape edging. Instead, a piece of pocket-forming material is secured along a bottom peripheral edge of the bottom outer fabric or covering of the mattress and projects freely upwardly inboard of the outer peripheral material or covering of the mattress which is tape secured along the entire periphery of the outer bottom fabric covering except in the area of the pocket-forming piece of material. The latter selective securing of the components creates an opening along a lower edge of the outer peripheral fabric or covering which defines with the pocket-forming material an upwardly accessible pocket into which the retention bracket is received. The latter construction provides an aesthetic appearance when the mattress is assembled upon the head, back, hip and leg supports of the adjustable bed because the retention bracket(s) is completely hidden from view to a casual observer.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
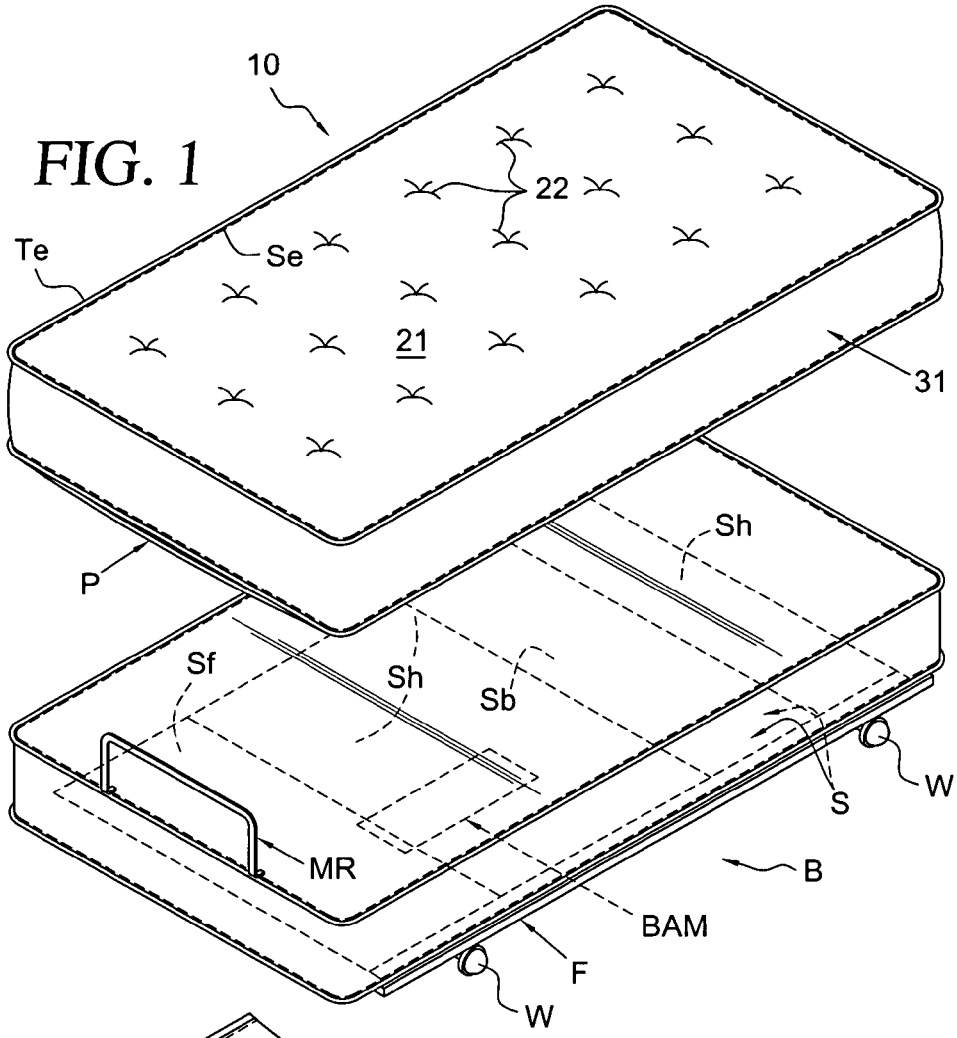
FIG. 1 is a perspective view of an adjustable bed, and illustrates a wheeled adjustable bed frame including relatively adjustable head, back, hip and leg supports; a mattress support supported upon the latter body supports carrying an inverted U-shaped mattress-retention bracket at a foot end, and a mattress above the mattress support prior to assembly therewith.
Figure 2:
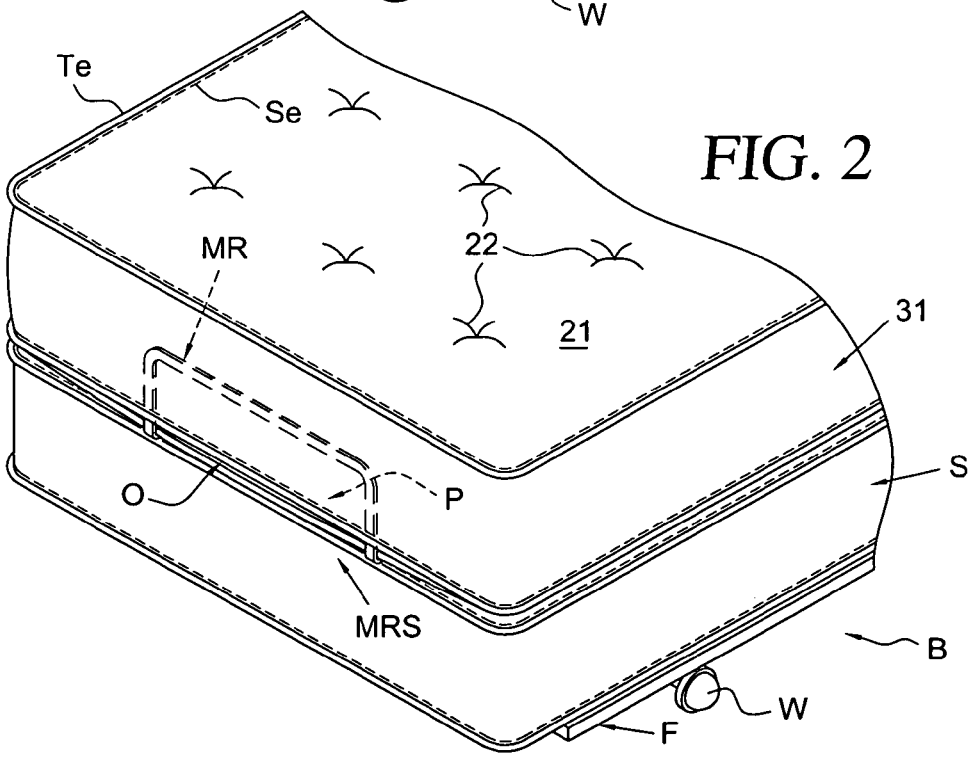
FIG. 2 is a fragmentary perspective view of the adjustable bed, and illustrates the retention bracket accessed within a pocket or chamber of the mattress through an opening formed along a portion of a lower peripheral edge of the mattress at the foot or head end thereof.

An adjustable bed B (FIGS. 1 and 2) includes a conventional frame F having wheels or casters W and appropriate linkages, motors and drives (not shown) of a conventional bed adjusting mechanism BAM for moving a mattress-supporting member or mattress support S between numerous positions of adjustment, as shown in FIGS. 1 and 2 of U.S. Pat. Nos. 5,737,783 and 5,978,992, the details of which are herein incorporated by reference. The mattress support S includes a mattress head support Sh, a mattress back support Sb, a mattress hip support Sh' and a mattress foot support Sf with the latter having secured thereto a mattress-retention bracket MR of a generally inverted U-shaped configuration. The bed adjusting mechanism BAM articulates the pivotally movable mattress supports Sh, Sb, Sh' and SF between planar (FIGS. 1 and 2) and nonplanar (not shown) positions. Though the mattress-retention bracket MR is located at the mattress foot support Sf, the same can be located at the mattress head support end Sh or at both mattress supports Sf, Sh.

The mattress bracket MR defines one component of a mattress-retention system MRS (FIG. 2) which includes as a second component thereof a mattress-retention bracket receiving pocket or chamber P (FIGS. 1 through 3) accessible through a lower opening O (FIGS. 3 and 7) of a mattress 10 which is constructed in a novel manner in accordance with the present invention.

Figure 5:
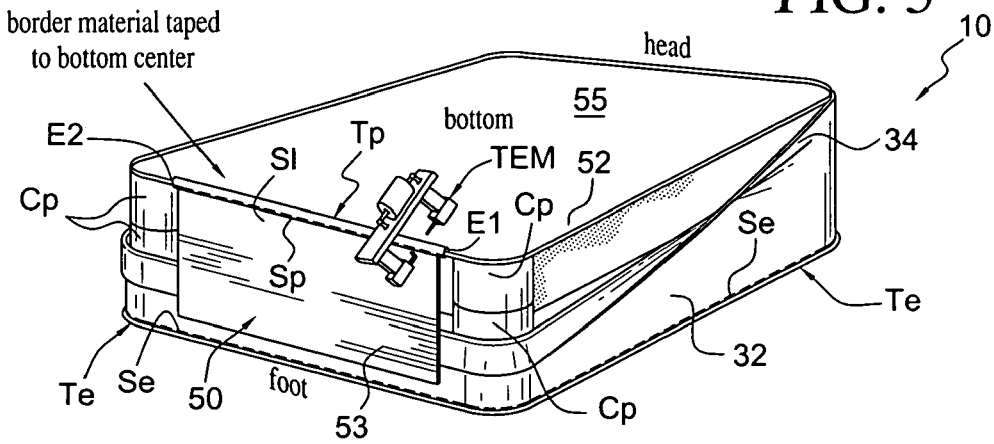
FIG. 5 is a schematic perspective view similar to FIG. 4, and illustrates a conventional tape edging machine securing a lower edge of the pocket-forming material to a peripheral edge of the bottom mattress covering.
Figure 6:
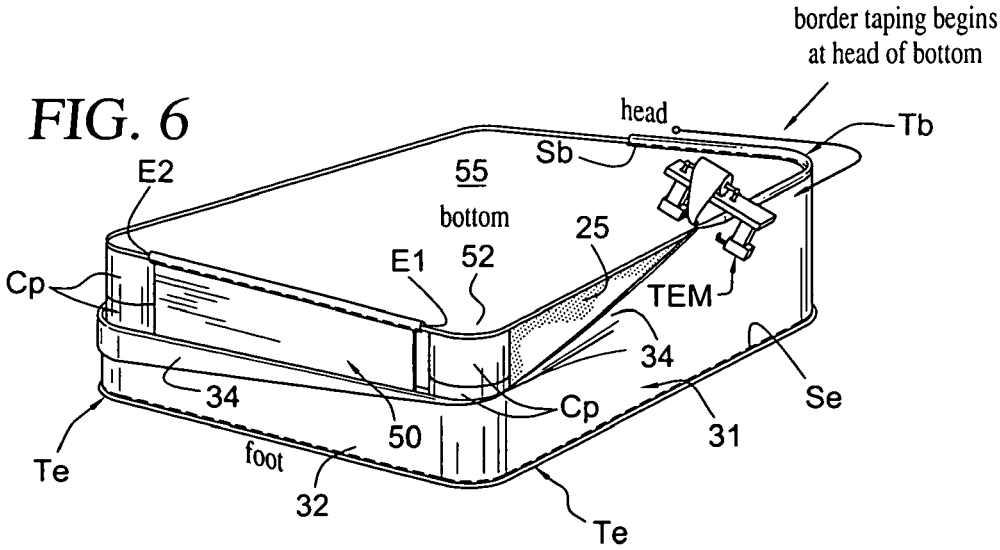
FIG. 6 is a schematic view of the mattress, and illustrates the tape edging machining securing the peripheral edge of the bottom mattress covering to the mattress peripheral covering lower edge beginning substantially midway at the head end of the mattress, continuing along the right side, the subsequent corner, excluding the area of the pocket (FIG. 5) previously tape edged only to the peripheral edge of the mattress bottom covering, continuing taping adjacent the succeeding corner and continuing to the mid-portion of the head end of the mattress.

The mattress 10 includes a mattress core 11 (FIG. 3) of a substantially conventional construction including coil springs 12 foam plastic corner pieces Cp (FIGS. 4-6), upper and lower relatively thick fabric layers 13, 14, respectively, and upper and lower relatively thin, though dense, mesh fabric 15, 16, respectively, with a layer of polymeric/copolymeric foam plastic material 17 being sandwiched between the layers 13, 15. Another foam layer 20 lies atop the fabric 15 and is covered by an outermost upper or top fabric material, cover or covering 21 defining the uppermost surface of the mattress 10 which can be appropriately stitched by spaced stitching 22 (FIG. 1) to impart a conventional quilted characteristic mattress appearance thereto. Outboard peripheral edge portions 25, 26 (FIG. 3) of the thin mesh fabric or fabric material 15, 16, respectively, are spaced from each other along the entire periphery of the mattress 10, as is readily apparent from FIG. 3. An outer peripheral covering 31 formed of a piece of fabric material peripherally bounds or encases the entire periphery of the mattress core 11 and an upper edge 32 thereof (FIG. 3) is secured by edge tape Te and edge stitching Se utilizing a conventional tape edging machine TEM (FIGS. 5 and 6) to entirely peripherally unite the peripheral covering 31 to an edge 33 of the top or upper fabric covering 21 (FIG. 3).

Figure 3:
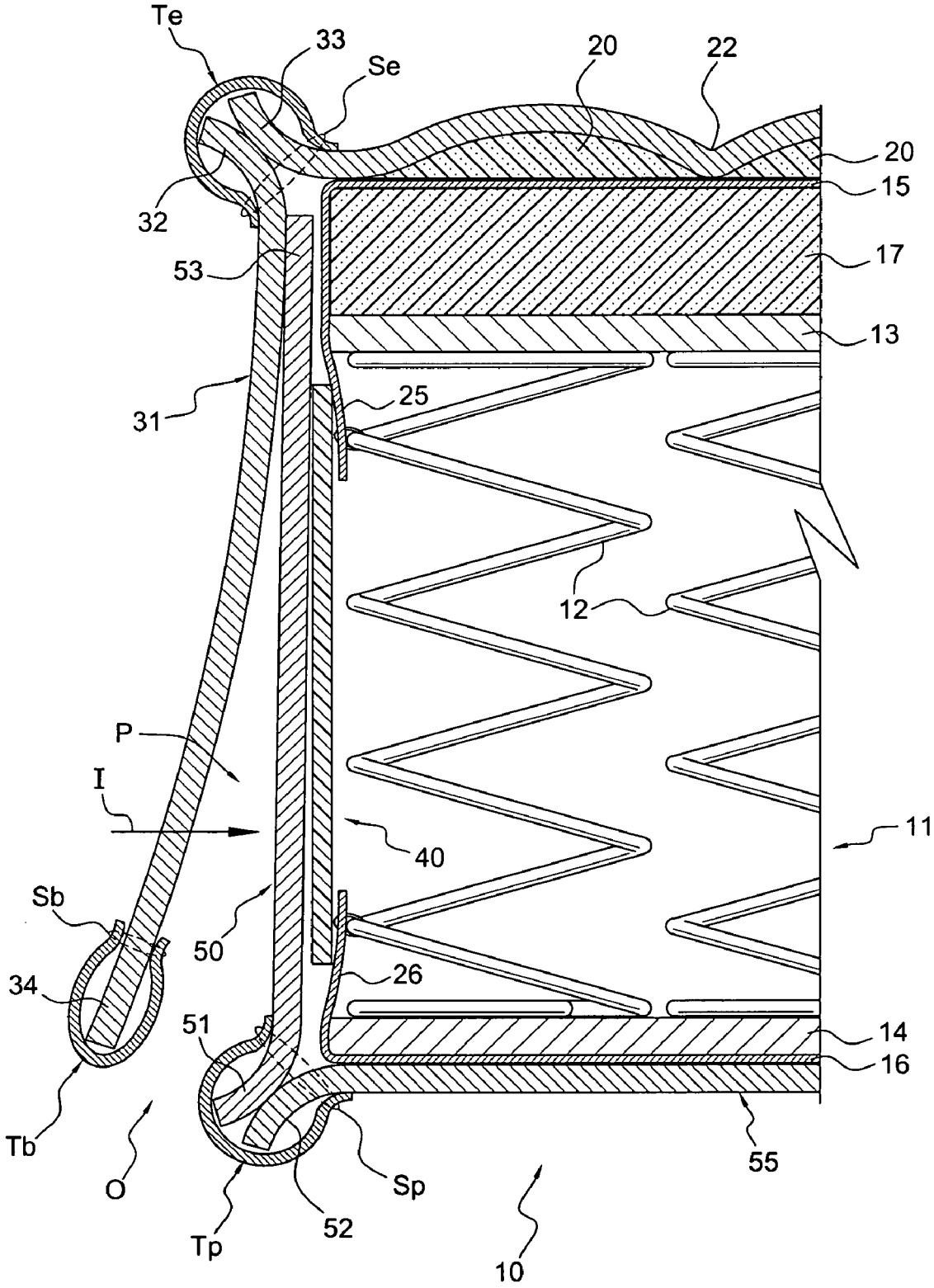
FIG. 3 is an enlarged fragmentary cross-sectional view of the mattress taken generally along line 3-3 of FIG. 7, and illustrates details of the chamber or pocket and the lower opening for accessing the pocket with the retention bracket by lowering the mattress from the position shown in FIG. 1 to the position shown in FIG. 2.
Figure 4:
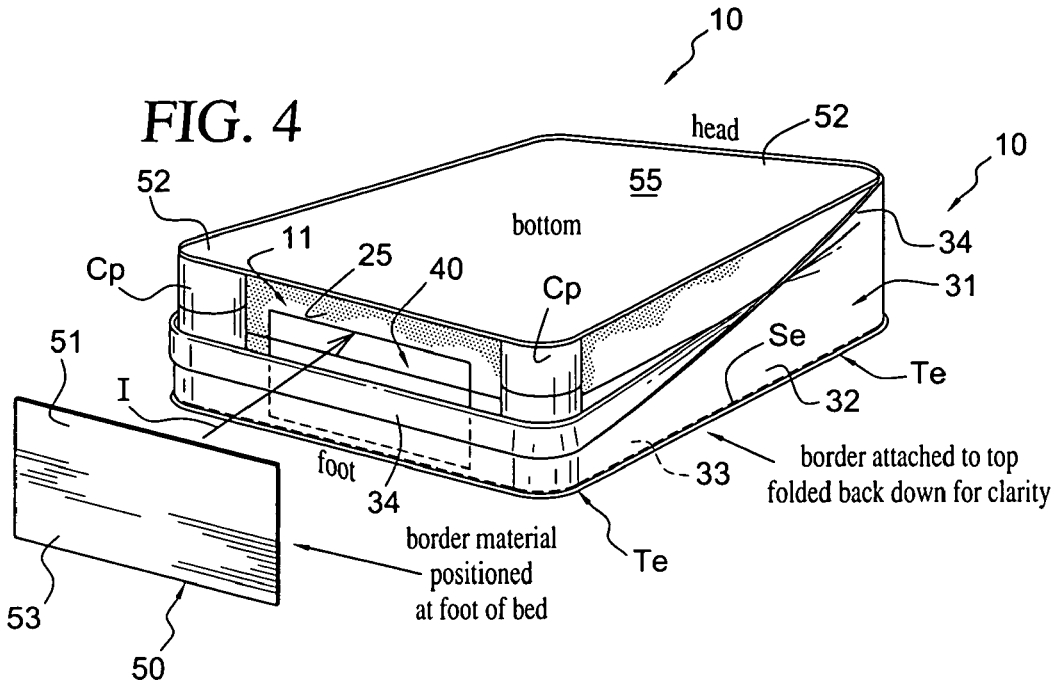
FIG. 4 is a schematic perspective view, and illustrates the mattress inverted with its bottom uppermost and a separate piece of pocket-forming border material which is insertable into a foot end (or head end) of the mattress inboard of the peripheral fabric or covering which is folded downwardly for purposes of assembly.

Reference is made to FIG. 4 of the drawings which illustrates the mattress 10 constructed as thus far described inverted from the position shown in FIG. 3 with the uppermost or top covering 21 at the bottom and the peripheral covering 31 projecting upwardly therefrom with a peripheral edge 34 thereof opposite the peripheral edge portion 32 being partially folded downwardly to expose the foot end of the mattress 10 and the inner core 11 thereof into which is inserted a substantially polygonal or rectangular piece of plastic reinforcing foam 40 (FIGS. 3 and 4) which reinforces the mattress 10 in the area of the pocket P, as is most readily apparent from FIG. 3 of the drawings.

The piece of reinforcing foam 40 slightly overlies the peripheral edge portions 25, 26 of the respective fabric pieces 15 and 16 (FIG. 3). Since the outer peripheral covering 31 relatively tightly encases the periphery of the mattress core 11, the reinforcing plastic foam piece 40 is retained frictionally therein in the position shown in FIG. 3 but may, if desired, be sewn or adhesively united to the edge portions 25, 26 of the pieces of material 15, 16.

Thereafter, a sheet of pocket-forming border material 50 of a polygonal configuration larger than that of the plastic foam piece 40 is inserted into the foot end of the mattress, as indicated by the headed arrow I associated therewith in FIG. 4 with an upper edge 51 thereof, as viewed in FIG. 4, which is the lower edge 51 in FIG. 3, immediately adjacent a foot edge 52 of a lower or bottom covering 55 of the mattress 10 and a remote terminal edge 53 (FIG. 3) being inboard of and adjacent the peripheral edges 32, 33 of the respective peripheral covering 31 and upper covering 21 (FIG. 3). Thereafter, a length of pocket-forming tape Tp (FIG. 5) is secured by stitching Sp of the conventional tape edging machine TEM to the edges 51, 52 of the respective pocket-forming border material 50 and bottom covering 55 only along the length of the tape Tp (FIG. 5) which corresponds to the length of the opening O which is formed when the peripheral covering 31 is subsequently progressively unfolded to cover the entirety of the pocket-forming fabric material 50, as is readily visualized in FIG. 6 of the drawings.

Figure 7:
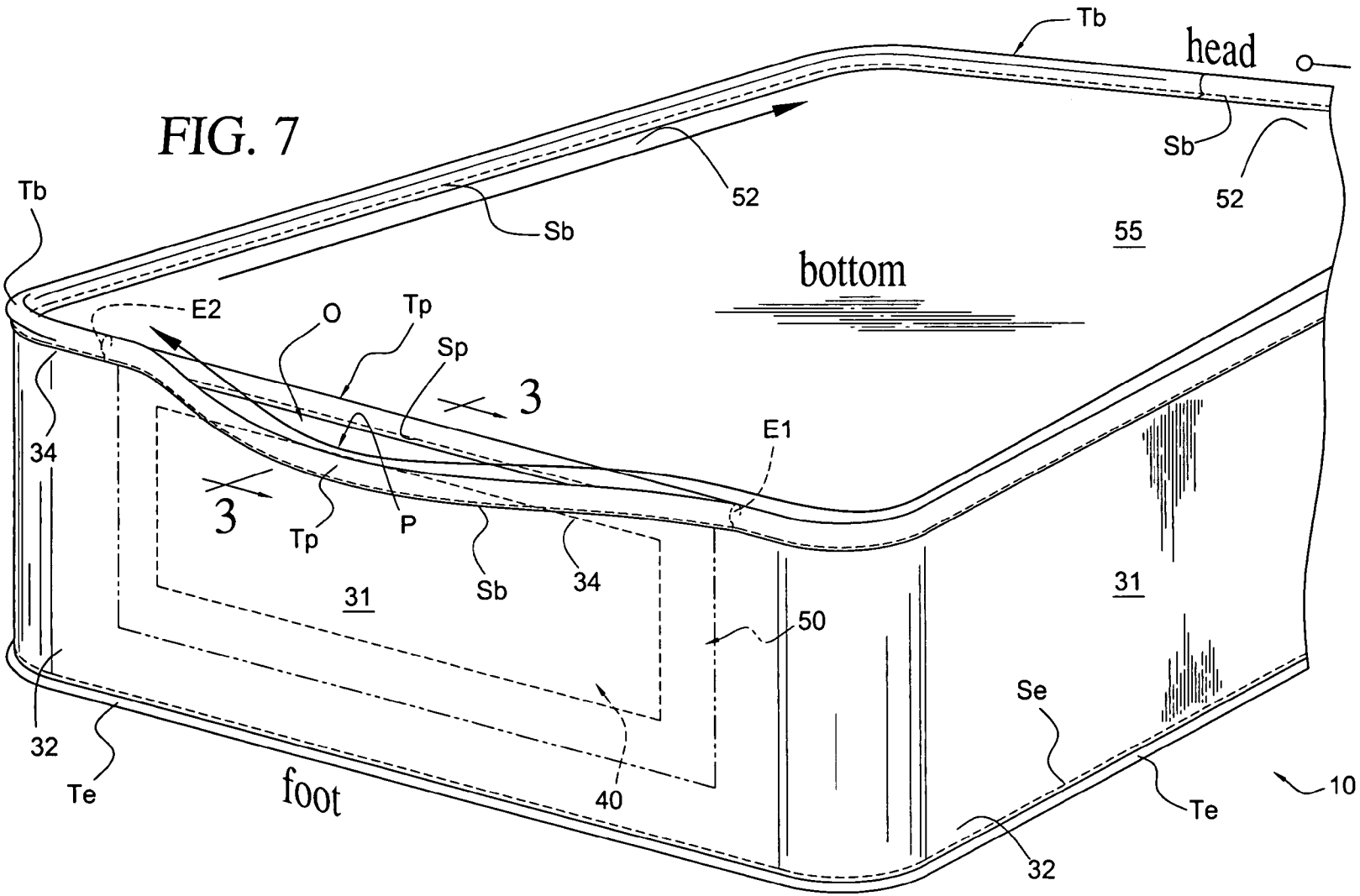
FIG. 7 is an enlarged fragmentary perspective view of the completed mattress of FIGS. 3 and 6 and specifically the pocket thereof, and illustrates the manner in which the peripheral edge taping of the peripheral covering excludes the area of the pocket-forming border material or insert to define an access area or opening opening into the mattress-retainer pocket or chamber.

Tape edging of the bottom covering 55 to the peripheral covering 31 by the tape edging machine TEM begins at the head end of the mattress (FIGS. 6 and 7) which applies bottom tape Tb and associated bottom stitching Sb (FIG. 3) to unite the peripheral edge 52 of the bottom covering 55 to the bottom edge 34 of the peripheral covering 31, along the entire lengths thereof except in the area of the tape Tp (FIG. 7). In other words, as is best visualized in FIGS. 6 and 7, the tape Tb secures the edges 52, 34 of the respective bottom covering 55 and peripheral covering 31 to each other halfway along the head end of the mattress (FIG. 6), around the adjacent corner, and along a portion of the right side. As the tape edging proceeds, the edges 52, 34 are secured to each other by the tape Tb until a first edge E1 (FIGS. 6 and 7) of the tape Tp is encountered, and at this point the tape Tb is applied only to the edge 34 (FIGS. 3 and 7) of the peripheral covering 31 until the edge Et of the tape Tp is reached at which point the edges 34, 52 are again secured to each other by the tape Tb which continues to the starting point of the edge taping operation at the head end of the mattress 10. In this manner, the opening O (FIGS. 3 and 7) is defined between the tape Tp and the opposing portion to the tape Tb of the peripheral covering 31 which permits upward access, as viewed in FIGS. 1-3, into the pocket or chamber P by the mattress-retention bracket MR in the manner readily apparent from FIGS. 1, 2 and 3 of the drawings. As is particularly emphasized in FIG. 2 of the drawings, the mattress-retention bracket MR is essentially invisible or unobservable because it is, obviously, hidden in the pocket P. Obviously, the bed-adjusting mechanism BAM (FIG. 1) can be selectively operated to adjust or articulate the adjustable bed B to and between desired positions of adjustment during which the mattress supports Sh, Sb, Sh' and Sf will pivot conventionally relative to each other. However, because the mattress-retention system MRS, specifically the mattress-retention bracket MR housed in the chamber or pocket P of the mattress 10, the mattress 10 will be held at all times in substantial peripheral alignment with the underlying mattress support S.

Although a preferred embodiment of the invention has been specifically illustrated and described herein, it is to be understood that minor variations may be made in the apparatus without departing from the spirit and scope of the invention, as defined by the appended claims.

The invention claimed is:

1. A mattress comprising upper and lower surfaces and a peripheral surface between said upper and lower surfaces collectively defining an interior of the mattress, means for accessing said mattress interior in a direction from said lower surface toward said upper surface and inboard of said peripheral surface for receipt of a mattress retainer, said upper, lower and peripheral surfaces being defined by respective upper, lower and peripheral fabric materials, means inboard of said peripheral fabric material for forming a chamber accessed through said accessing means, said chamber-forming means being a sheet of material inboard of said peripheral fabric material, and said sheet of material and said peripheral fabric material each having a terminal edge adjacent respectively said upper fabric material and said lower fabric material.

2. A bed comprising the combination of a mattress and a mattress support, said mattress including upper and lower surfaces and a peripheral surface between said upper and lower surfaces collectively defining an interior of the mattress, said mattress being supported by said mattress support, means for accessing said mattress interior in a direction from said lower surface toward said upper surface and inboard of said peripheral surface for receipt of a mattress retainer, and retaining means carried by and projecting upwardly from said mattress support and accessing said mattress interior through said accessing means to thereby retain the mattress relative to the mattress support.

3. The bed as defined in bed claim 2 wherein said upper, lower and peripheral surfaces are defined by respective upper, lower and peripheral fabric materials, and said accessing means is an opening defined by at least one of the lower and peripheral fabric materials.

4. The bed as defined in claim 2 wherein said upper, lower and peripheral surfaces are defined by respective upper, lower and peripheral fabric materials, means inboard of said peripheral fabric material for forming a chamber accessed through said accessing means, and said chamber-forming means being a sheet of material inboard of said peripheral fabric material.

5. The bed as defined in claim 2 wherein said upper, lower and peripheral surfaces are defined by respective upper, lower and peripheral fabric materials, means inboard of said peripheral fabric material for forming a chamber accessed through said accessing means, said chamber-forming means being a sheet of material inboard of said peripheral fabric material, and said sheet of material and said peripheral fabric material each having a terminal edge adjacent respectively said upper fabric material and said lower fabric material.

6. A bed comprising the combination of a mattress and a mattress support, said mattress including relative spaced upper and lower fabric material and peripheral fabric material therebetween, a piece of material inboard of a portion of the peripheral fabric material and defining a pocket therewith, means for accessing said pocket in a direction from said lower fabric material toward said upper fabric material for receipt of a mattress retainer, said mattress being supported by said mattress support, and retainer means carried by and projecting upwardly from said mattress support and into said pocket through said accessing means to thereby retain the mattress relative to the mattress support.

7. The bed as defined in claim 6 wherein said pocket is accessed by an opening along a lower edge portion of said peripheral fabric material portion.

8. The bed as defined in claim 6 including means for securing said lower fabric material and said peripheral fabric material to each other at opposite sides of said accessing means.

9. The bed as defined in claim 6 including means for securing said lower fabric material and said peripheral fabric material to each other at opposite sides of said accessing means, and said lower fabric material being unconnected to said peripheral fabric material portion between opposite ends of said accessing means.

10. A bed comprising the combination of a mattress and a mattress support, said mattress including upper and lower surfaces and a peripheral surface therebetween, means for forming a pocket inboard of said peripheral surface for receipt of a mattress retainer, means exterior of said pocket for reinforcing said pocket, said mattress being supported by said mattress support, and said mattress support carrying an upwardly projecting retainer projecting upwardly from said mattress support and into said pocket to thereby retain the mattress relative to the mattress support.

11. The bed as defined in claim 10 wherein in said upper, lower and peripheral surfaces are defined by respective upper, lower and peripheral fabric materials, a mattress core inboard of said reinforcing means, and said reinforcing means being disposed between said mattress core and said peripheral fabric material.

* * * * *